US005823168A

United States Patent [19]

Otoh et al.

[11] Patent Number: 5,823,168

[45] Date of Patent: Oct. 20, 1998

[54] FUEL INJECTION PUMP

[75] Inventors: Takashi Otoh; Mitsuhiro Murata, both of Kawasaki, Japan

[73] Assignee: Isuzu Motors Limited, Tokyo, Japan

[21] Appl. No.: 753,992

[22] Filed: Dec. 3, 1996

[30] Foreign Application Priority Data

Dec. 6, 1995 [JP] Japan ..... 7-318094

[51] Int. Cl.[6] ..... F02M 59/26

[52] U.S. Cl. ..... 123/496; 123/500

[58] Field of Search ..... 123/446, 500, 123/501, 496, 506

[56] References Cited

U.S. PATENT DOCUMENTS

| | | | |
|---|---|---|---|
| 2,591,401 | 5/1952 | Camner . | |
| 4,737,086 | 4/1988 | Yamaguchi et al. | 123/500 |
| 4,754,737 | 7/1988 | Ishida et al. . | |
| 4,836,170 | 6/1989 | Hafele | 123/501 |
| 5,211,549 | 5/1993 | Kraemer | 123/500 |
| 5,315,978 | 5/1994 | Ishida | 123/506 |
| 5,592,915 | 1/1997 | Ishiwata et al. | 123/501 |

FOREIGN PATENT DOCUMENTS

| | | |
|---|---|---|
| 0453227 | 10/1991 | European Pat. Off. . |
| 1476221 | 6/1969 | Germany . |
| 1950019 | 6/1970 | Germany . |

*Primary Examiner*—Thomas N. Moulis
*Attorney, Agent, or Firm*—Rader, Fishman & Grauer PLLC

[57] ABSTRACT

The fuel injection pump does not generate an excessively large drive torque at the end of the fuel injection under the condition of the most advanced injection timing, even if a geometric injection rate (GIR) is raised to shorten an injection period. The fuel injection pump includes a sleeve (4), a plunger (1) movably received in the sleeve (4), a cam (2') for moving the plunger up and down in the longitudinal direction of the sleeve. The sleeve is shiftable relative to the plunger in the longitudinal direction of the plunger to delay or advance an injection timing and to use different portions of the cam from start (22) to end (23) of fuel injection. The cam (2') has a unique configuration to insure that when the sleeve is shifted downward and the fuel. injection timing is most advanced, the GIR drops from the start of the injection to the end.

3 Claims, 4 Drawing Sheets

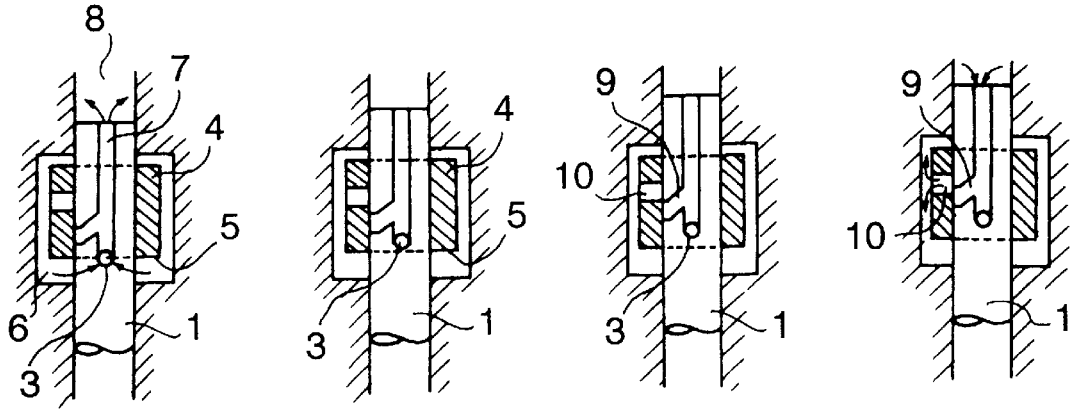
FIG. 5A FIG. 5B FIG. 5C FIG. 5D
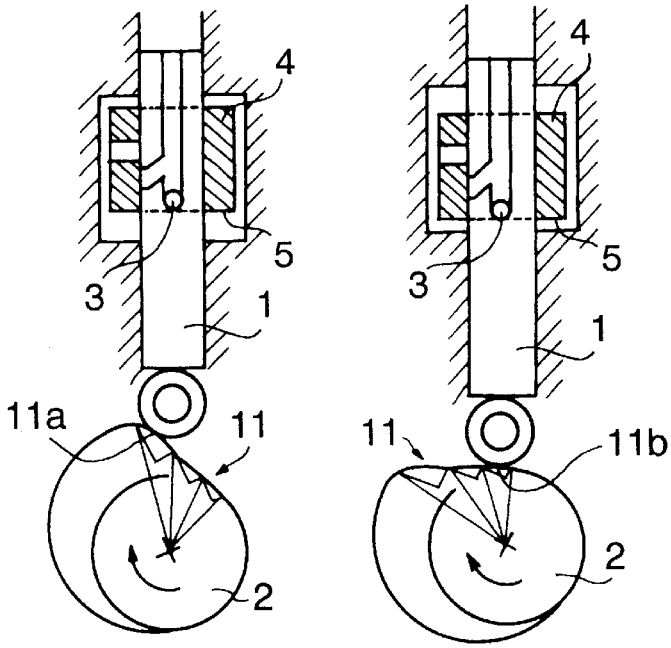
FIG. 6A
PRIOR ART
FIG. 6B
PRIOR ART

FUEL INJECTION PUMP

BACKGROUND OF THE INVENTION

1. Technical Field

This invention relates to a fuel injection pump of which injection timing and injection rate are adjustable.

2. Background Art

Some of known fuel injection pumps are controllable in injection timing and injection rate. One example of such fuel injection pumps is illustrated in FIGS. 5A through 6B of the accompanying drawings. As understood from these illustrations, the fuel injection pump has a sleeve 4, a plunger 1 movably received in the sleeve 4 and a cam 2 for moving the plunger 1 up and down for injection of fuel. The cam 2 is driven interlocking with rotation of a crankshaft of a diesel engine (not shown). A fuel is pressurized by the injection pump before fed to an injection nozzle (not shown) in the following manner.

Referring first to FIG. 5A, before an intake port 3 formed in the plunger 1 is closed by a lower end 5 of the sleeve 4, the fuel in an oil reservoir space 6 is allowed to enter the intake port 3 and to flow through an oil passage 7 to a compression chamber 8 as indicated by the arrows. Then, as illustrated in FIG. 5B, fuel compression and injection start when the intake port 3 of the plunger 1 is closed by the lower end 5 of the sleeve 4 due to upward movement of the plunger 1 by the cam 2. FIG. 5C depicts the plunger 1 during feeding of the pressurized fuel to the nozzle. After that, as shown in FIG. 5D, a leakage groove 9 formed in the plunger 1 communicates with a spill port 10 formed in the sleeve 4 so that the pressure in the compression chamber 8 is released because the fuel flows back to the fuel reservoir space 6 as indicated by the arrows. Accordingly, the injection is completed.

Referring now to FIG. 6A, if the sleeve 4 is shifted upward relative to the plunger 1, the timing of when the intake port 3 of the plunger 1 is closed by the lower end 5 of the sleeve 4 (i.e., the injection initiation timing) is delayed. In this case, the fuel injection starts when the most projecting portion 11*a* of a nose 11 of the cam 2 approaches the top of the rotation. The injection timing is delayed because an extra rotation angle of the cam 2 is required until injection. In other words, the largest cam angle is necessary until the fuel injection is initiated. In this case, the stroke from the bottom dead center of the plunger 1 to the fuel injection (generally referred to as "prestroke") becomes maximum (see FIG. 7: "MAX PRESTROKE"). On the other hand, if the sleeve 4 is shifted downward relative to the plunger 1 as depicted in FIG. 6B, the injection starts when a root portion 11*b* of the cam nose 11 reaches the top of the rotation. In this case, the fuel injection timing is advanced and the prestroke becomes minimum (see FIG. 7: "MIN PRESTROKE").

The nose 11 of the cam 2 is shaped such that the plunger lifting speed is slower at the nose root portion 11*b* and higher at the nose front portion 11*a*. Therefore, if the prestroke is reduced and the fuel injection timing is advanced (FIG. 6B), then the fuel injection rate is lowered. On the other hand, if the prestroke is extended and the fuel injection timing is delayed (FIG. 6A), the fuel injection rate is raised.

Taking advantage of this, the diesel engine is generally controlled such that the injection timing is delayed and the injection rate is raised when the engine is operated in a low speed range whereas the injection timing is advanced and the injection rate is lowered when the engine is operated in a high speed range. Owing to such control, it is possible to inject the fuel at a high pressure even when the engine is operated in a low speed range (or when the rotational speed of the cam 2 is low). Accordingly, optimum injection timing and rate are realized in the whole operation range of the engine. Further, misfiring in a high speed range is prevented.

Referring to FIG. 7, the conventional cam 2 has a variable prestroke range 12 as mentioned above. In this range 12, the plunger lifting speed or geometric injection rate (GIR) is raised as the cam angle increases. In other words, as seen FIG. 7, the GIR curve rises diagonally in the variable prestroke range 12 as a larger cam angle is needed to start the fuel injection. This diagonally rising GIR curve is employed to reduce NOx in an initial state of the engine operation by suppression of injection rate and smokes in a later state by raising of injection rate.

In the meantime, there is known relationship among the injection pressure P, the engine rotational speed Ne and the amount of fuel injected Q, which is $P \propto Ne \times Q$. Also, the relationship $T \propto P \times GIR$ exists among the injection pump drive torque T, the injection pressure P and the geometric injection rate GIR. Therefore, the higher the engine rotational speed Ne, the larger the drive torque T, and the larger the amount of fuel injected Q, the larger the drive torque T. Accordingly, the torque for driving the pump T reaches its maximum value when the amount of fuel injected Q takes the maximum value while the engine is being operated at a high speed, i.e., when the engine exerts the greatest horsepower.

When the engine produces the largest horsepower (i.e., when operated at a high speed with a large amount of fuel injection), the sleeve 4 is shifted to the lowest position as illustrated in FIG. 6B to inject the fuel at the earliest timing or to minimize the prestroke (MIN PRESTROKE in FIG. 7). In this case, the cam 2 is used for fuel injection in the range 50 as shown in FIG. 7. This range 50 indicates from the beginning of injection to the end, which range may be referred to as cam usage range. The cam 2 is designed to have a particular shape such that the GIR curve goes up diagonally according to the increasing cam angle in this range 50. With a fuel injection pump having such a cam, it is known that the pump drive torque T takes the maximum value instantaneously when the fuel injection is completed (i.e., the point indicated by the line 14) in consideration of a repulsive force against compression increased according to lifting up of the plunger 1.

Incidentally, in order to cope with recent strict exhaust gas restrictions and regulations, an injection hole of an injection nozzle tends to be as small as possible so that more atomized fuel particles are injected into a combustion chamber. However, the smaller injection nozzle hole results in an extended injection period in a high speed operation range of the engine as long as the conventional cam 2 having the above described geometric injection rate is employed. This in turn results in deterioration of engine performances such as lower combustion efficiency, larger amount of smokes and raised exhaust gas temperature. In particular, these deteriorations in the engine performances are significant in highly supercharged and high displacement engines.

To deal with these problems, another type of cam may be employed which has a higher GIR as indicated by the phantom line 13 in FIG. 7. This cam could inject the fuel at a higher pressure and reduce the injection period. However, as long as the GIR curve increases upward with the increased cam angle like the previous cam 2, the pump drive torque T at the end of the fuel injection 14 becomes excessively large even if such a new cam is used. This degrades durability of the engine considerably.

Still another type of fuel injection pump is known in the art (Japanese Utility Model Application, Publication No. 4-107478, entitled "Fuel Injection Pump"). Relationship between the plunger lifting speed and the cam angle of this prior art is illustrated in FIG. 8 of the accompanying drawings. The fuel is injected in the cam angle range E under a heavy load condition, and injected in the range F under a light load condition. As understood from this graph, the fuel injection in the heavy load range E is carried out while the plunger lifting speed is high. The lifting speed increases steeply upon initiation of the fuel injection and decreases thereafter so that this arrangement cannot suppress the pump drive torque. In order to suppress the pump drive torque, the lifting speed should continuously decrease upon start of fuel injection at least until the end of fuel injection.

Other types of fuel injection pump are disclosed, for example, in Japanese Patent Application, Publication Nos. 4-148058 and 5-340321.

SUMMARY OF THE INVENTION

One object of the present invention is to provide a fuel injection pump which can decrease the pump drive torque at the end of the fuel injection under a condition of high speed, large amount of fuel injection and advanced cam angle even if injection rate is increased to shorten the fuel injection period.

According to one aspect of the present invention, there is provided a fuel injection pump comprising a sleeve, a plunger movably received in the sleeve and a cam for moving the plunger up and down in the sleeve. The cam has a shape defined by a plurality of portions. The plunger is shiftable in the longitudinal direction of the sleeve to delay or advance a timing of fuel injection and to use different portions of the cam from start of fuel injection to end of fuel injection. The shape of the cam is determined such that it causes a geometric injection rate to drop from the start of fuel injection to the end of fuel injection when the fuel injection timing is most advanced by shifting the sleeve downward.

The torque for driving the plunger takes a maximum value at the end of the fuel injection while the fuel injection pump is being operated with the most advanced injection timing with the sleeve located at the bottom position and the engine is operating at a high speed. The cam of the invention can lower the maximum drive torque because GIR decreases in right-hand down curve in the actual operation range from the start to the end of the injection under the condition of most advanced angle. As a result, the drive torque by the cam is suppressed. Because of this, the average GIR from the start of injection to the end may be raised if the cam of the invention is employed.

These and other objects and advantages of the fuel injection pump of the present invention will become more apparent as the following detailed description and the appended claims are read and understood with the accompanying drawings.

BRIEF DESCRIPTION OF THE ACCOMPANYING DRAWINGS

FIG. 5A to 5D depict in combination how a fuel is injected by a plunger slidably received in a sleeve of a general fuel injection pump;

FIG. 6A illustrates an upwardly shifted sleeve to delay an injection timing of the fuel injection pump shown in FIGS. 5A–5D;

FIG. 6B illustrates a downwardly shifted sleeve to advance the injection timing;

DETAILED DESCRIPTION OF THE PREFERRED EMBODIMENTS

Preferred embodiments of the present invention will be described in reference to the accompanying drawings.

Figure 1:
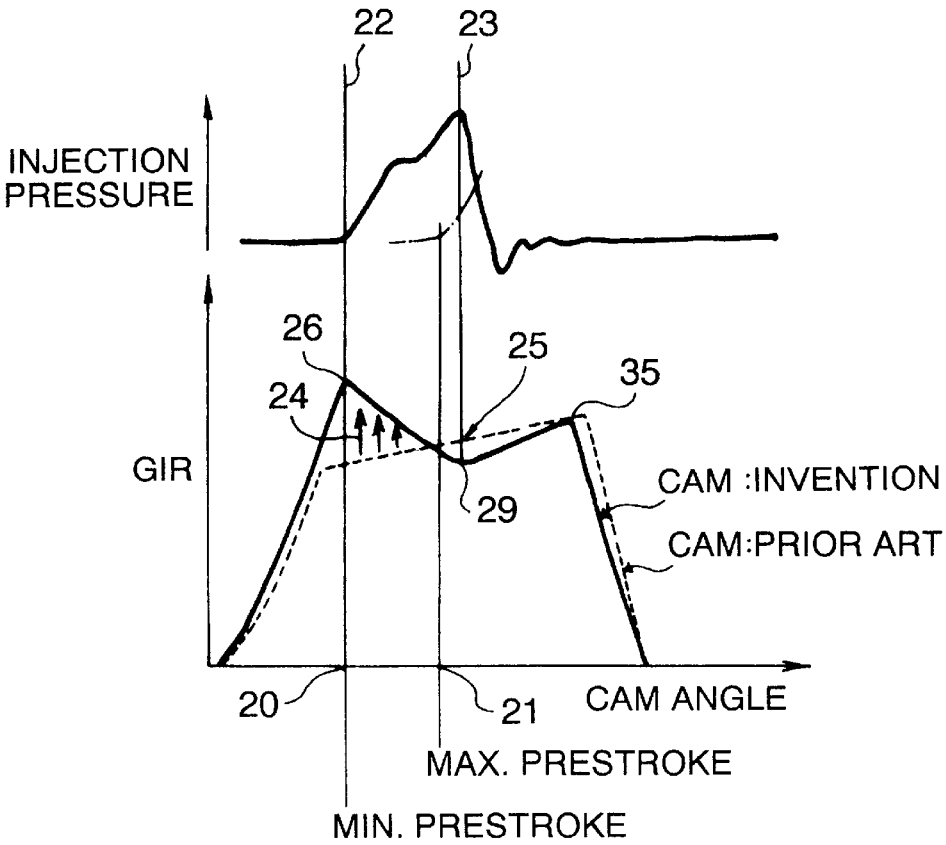
FIG. 1 illustrates relationship between a cam angle, a geometric injection rate (GIR) and an injection pressure of a fuel injection pump according to the present invention.

Referring first to FIG. 1, illustrated are curves showing relationship between a cam angle and a geometric injection rate (GIR) and that between the cam angle and an injection pressure. In this graph, the point 20 on the cam angle axis indicates a cam angle at the minimum prestroke which corresponds to FIG. 6B with the downwardly shifted sleeve 4. When the prestroke is the smallest, the injection timing is most advanced. This design is utilized when the engine is driven at a high speed. The point 21 on the horizontal line of the graph in FIG. 1 indicates a cam angle at the largest prestroke which corresponds to FIG. 6A with the upwardly shifted sleeve 4. The injection timing is most delayed when the prestroke is the maximum so that this design is utilized when the engine is driven at a low speed.

In the present invention, a cam 2' has a unique configuration such that the GIR does not rise but drop in the cam usage range (i.e., from the start of the fuel injection (line 22 in FIG. 1) to the end (line 23)) when the sleeve 4 is shifted down to minimize the prestroke (point 20) and to most advance the injection timing. Specifically, the GIR (lifting velocity) curve declines between the lines 22 and 23 as illustrated in FIG. 1. It should be noted that the plunger lifting speed also drop as the GIR drops.

The GIR curve of the conventional cam 2 is indicated by the dotted line.

As understood from comparison of the solid line curve to the dotted line curve, the GIR of the cam 2' is higher than that of the conventional cam 2 at the start of injection 22 whereas it is smaller than the conventional one at the end of injection 23. In addition, the average GIR between the injection start line 22 and end line 23 of the cam 2' is greater than the conventional cam 2. In FIG. 1, the arrows 24 indicate that the fuel is injected at a higher pressure due to increased GIR and the arrow 25 indicates a point when the maximum drive torque is generated according to the cam 2' of the invention. It should be noted that the injection start point 22 corresponds to FIG. 5B and the injection end point 23 to FIG. 5D.

Figure 2:
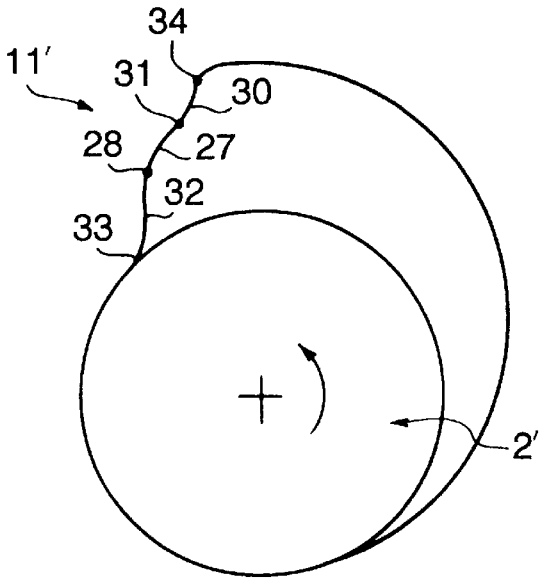
FIG. 2 illustrates a shape of a cam which has characteristics shown in FIG. 1.

A detailed shape of the cam 2' of the invention is illustrated in FIG. 2. Referring to FIGS. 1 and 2, relationship between the GIR and cam shape will now be described.

The injection start point 26 in FIG. 1 corresponds to an approximate peak 28 of a convex 27 of a nose 11' of the cam 2' in FIG. 2 and the injection end point 29 in FIG. 1 corresponds to an approximate bottom 31 of a concave 30 of the nose 11' in FIG. 2. Therefore, the GIR gradually drops from the point 28 to the point 31 in FIG. 2.

When the cam 2' angle reaches the point 25, the pump drive torque indicates the maximum value. This point is also a point when the fuel injection is finished under a condition of high engine speed, large amount of fuel injection and most advanced injection timing.

By setting the GIR at the point 25 of the cam 2' to that of the conventional cam 2 or less, the drive torque of the cam 2' becomes smaller than that of the cam 2 even if the average GIR between the injection start point 22 and the end point 23 is greater than the conventional one. Since the drive torque of the cam 2' does not become excessively large, the durability of the engine which uses the improved fuel injection pump of the invention is not deteriorated. No special measures are necessary on the engine side for coping with problems due to high drive torque exerted by the cam 2'.

In this particular embodiment, the cam 2' has a configuration such that the GIR rises after the injection end point 29, with the injection timing being most advanced. Specifically, the GIR curve of the cam 2' has an M shape having two peaks 26 and 35 with the point 29 being the center as seen in FIG. 1. Since the GIR is set to increase after the injection end point 29 while the injection timing is being most advanced, the fuel injection is carried out like the conventional pump (i.e., the injection rate pattern is low in the initial state and high in the later state) when the engine operates at a low speed and the prestroke is set to the maximum (line 21).

Referring particularly to FIG. 2, the nose 11' of the cam 2' includes the first concave portion 32, the convex portion 27 and the second concave portion 30 continuously from the start of its nose portion 11'. If the cam 2' is used, the GIR increases from the rise-up point 33 of the nose 11 or the beginning of the first concave 32 to the approximate peak 28 of the convex 27, decreases from the approximate peak 28 to the approximate bottom 31 of the second concave 30 and increases from the approximate bottom 31 to the end 34 of the second concave 30. The point 26 in FIG. 1 corresponds to the point 28 in FIG. 2, the point 29 in FIG. 1 to the point 31 in FIG. 2, and the point 35 in FIG. 1 to the point 34 in FIG. 2 respectively.

Figure 3:
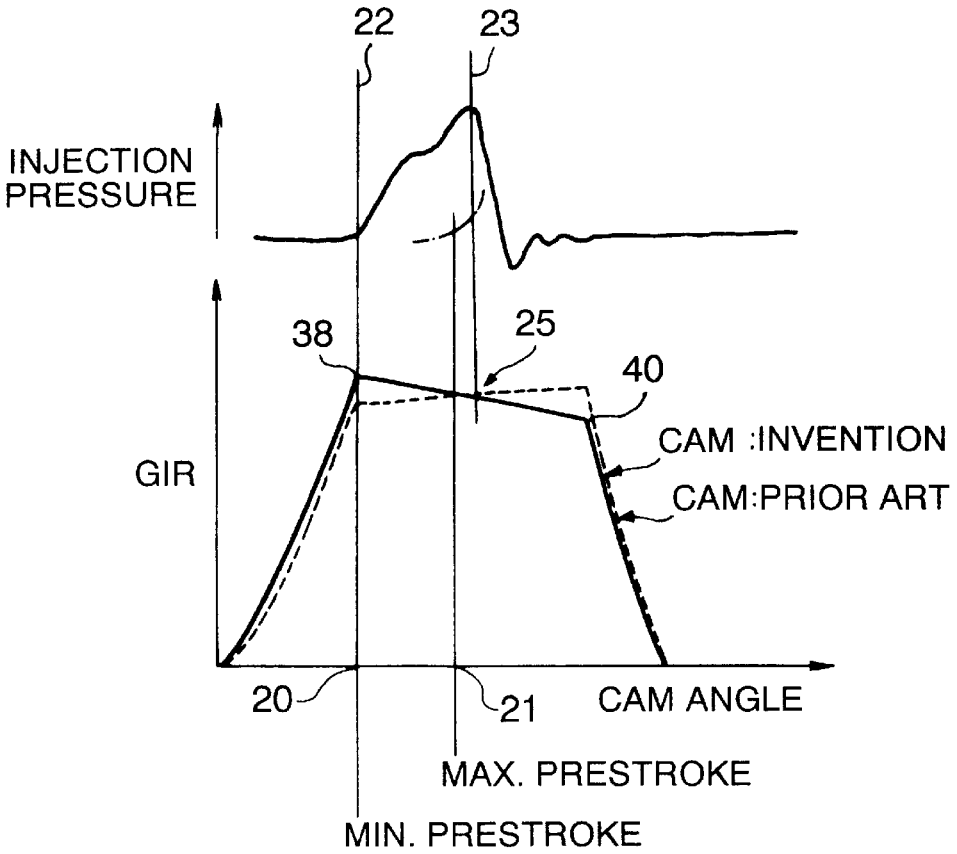
FIG. 3 illustrates relationship between a cam angle, a geometric injection rate and an injection pressure of another fuel injection pump according to the present invention.

The present invention is not limited to the above embodiment. For example, the GIR curve may not have the M shape but a simply declining line at its top as illustrated in FIG. 3. Specifically, the GIR curve may not bend upward after the point 25. In this case, the drive torque at the point 25 (i.e., when the maximum torque is generated by the cam 2" or when the injection is completed under a condition of high engine speed and most advanced injection timing: line 23) can also be suppressed. In this case, the nose 11" of the cam 2" includes a smaller concave portion 36 and a larger convex portion 37. The injection start point 38 in FIG. 3 corresponds to the approximate end 39 of the concave 36 in FIG. 4 and the upper right corner 40 in FIG. 3 to the approximate end 41 of the convex 37 in FIG. 4. Consequently, the GIR further decreases from the approximate end 39 of the concave 36 to the approximate end 41 of the convex 37.

Figure 4:
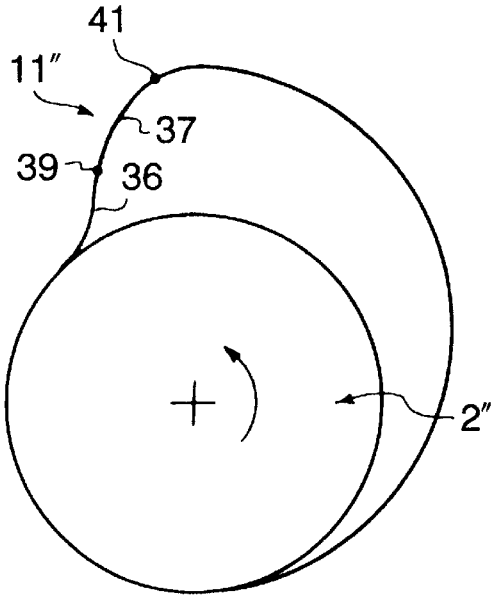
FIG. 4 illustrates a shape of a cam which has characteristics shown in FIG. 3.
Figure 7:
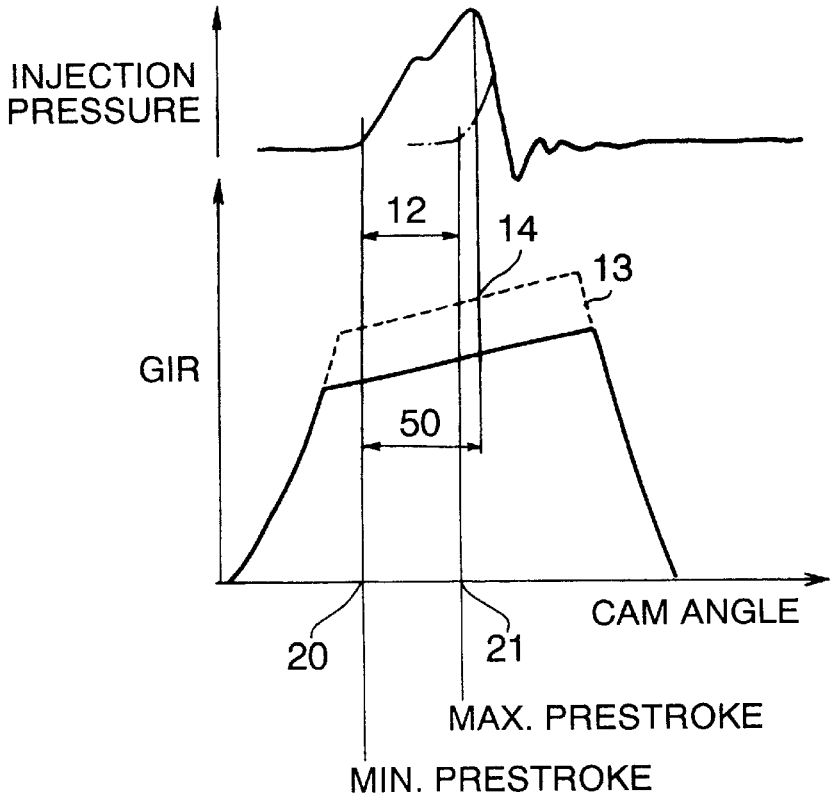
FIG. 7 PRIOR ART
FIG. 7 illustrates relationship between a cam angle, a geometric injection rate and an injection pressure of a conventional fuel injection pump.
Figure 8:
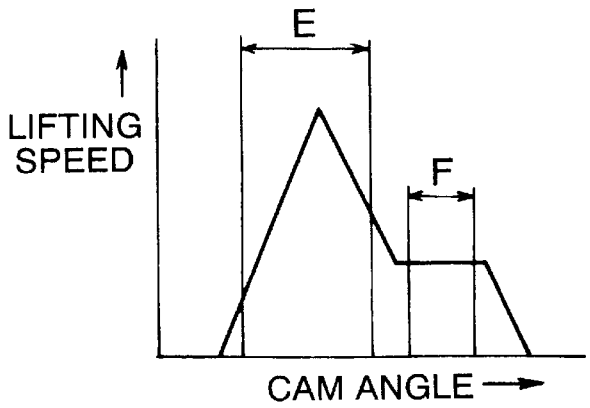
FIG. 8 PRIOR ART
FIG. 8 illustrates relationship between a plunger lifting speed and a cam angle of another conventional fuel injection pump.

In both of the arrangements of FIGS. 2 and 4, the plunger lifting speed (or the GIR) gradually decreases after the initiation of fuel injection (i.e., after the minimum prestroke line 20) while the engine is operating under a heavy load (or high speed driving) condition, so that the decreasing of the drive torque is attained. In the present invention, the plunger lifting speed or GIR always declines under the heavy load condition or high speed condition to prevent the drive torque from becoming excessively large until at least the fuel injection is completed.

The torque for driving the plunger exerted by the cam takes a maximum value at the end of the fuel injection while the fuel injection pump is being operated with the most advanced injection timing. The cam of the invention can lower the maximum drive torque by having the above configuration. Therefore, the GIR can be raised further and consequently the fuel injection pump can have a higher injection efficiency.

What is claimed is:

1. A fuel injection pump comprising:

a sleeve;

a plunger movable received in the sleeve; and a cam for moving the plunger up and down in the sleeve for fuel injection, the cam having a shape defined by a plurality of portions, wherein the plunger reciprocates in the longitudinal direction of the sleeve to delay or advance a timing of fuel injection and to use different portions of the cam from start of fuel injection to end of fuel injection, the shape of the cam causing a geometric fuel injection rate to drop from the start of fuel injection to the end of fuel injection when the fuel injection timing is most advanced by shifting the sleeve downward.

2. The fuel injection pump of claim 1, wherein the cam has a shape such that the geometric injection rate increases after the end of fuel injection while the fuel injection timing is being most advanced.

3. The fuel injection pump of claim 1, wherein the cam has a shape such that the geometric injection rate further drops after the end of fuel injection while the fuel injection timing is being most advanced.

* * * * *